US007258544B2

(12) United States Patent
Rasmussen

(10) Patent No.: US 7,258,544 B2
(45) Date of Patent: Aug. 21, 2007

(54) METHOD AND APPARATUS FOR IGNITING A GAS FLARE AND A GAS FLARE

(76) Inventor: Adair Rasmussen, 4828-53A Street, Camrose, Alberta (CA) T4V 1Z9

( * ) Notice: Subject to any disclaimer, the term of this patent is extended or adjusted under 35 U.S.C. 154(b) by 154 days.

(21) Appl. No.: 10/523,134

(22) PCT Filed: Jul. 17, 2003

(86) PCT No.: PCT/CA03/01074

§ 371 (c)(1),
(2), (4) Date: Jan. 21, 2005

(87) PCT Pub. No.: WO2004/010051

PCT Pub. Date: Jan. 29, 2004

(65) Prior Publication Data

US 2005/0282099 A1 Dec. 22, 2005

(30) Foreign Application Priority Data

Jul. 22, 2002 (CA) ..... 2394368

(51) Int. Cl.
*F23G 7/08* (2006.01)
*F23Q 7/06* (2006.01)

(52) U.S. Cl. ..... 431/258; 431/202; 431/5

(58) Field of Classification Search ..... 431/5, 431/170, 202, 258, 256, 254; 110/210, 214, 110/250; 422/169, 174, 189
See application file for complete search history.

(56) References Cited

U.S. PATENT DOCUMENTS 2,888,981 A 6/1959 Ripple
3,807,940 A 4/1974 Juricek
4,184,838 A 1/1980 Burns et al.
4,490,106 A 12/1984 Lazarre et al.
5,938,426 A * 8/1999 McGehee ..... 431/202

FOREIGN PATENT DOCUMENTS

| | | | |
|---|---|---|---|
| DE | 23 26 750 | | 12/1974 |
| DE | 33 39 543 A1 | | 5/1985 |
| FR | 2 593 271 | * | 1/1986 |
| FR | 2 593 271 | | 7/1987 |
| WO | WO 01/73351 A1 | | 10/2001 |

* cited by examiner

*Primary Examiner*—Alfred Basichas
(74) *Attorney, Agent, or Firm*—Christensen O'Connor Johnson Kindness PLLC

(57) ABSTRACT

A method and apparatus for igniting a gas flare includes a housing (12, 112) and at least one flow passage (14, 120) extending through the housing (12, 112). A body (16, 124) made from a heat conducting material in communication with the at least one flow passage (14, 120). A heating element (18, 126) embedded in the body (16, 124) maintains the body (16, 124) at a temperature above an ignition temperature of a combustible mixture of combustion air and combustible gases. The combustible mixture passing along the at least one flow passage (14, 120) is ignited immediately upon coming in contact with the body (16, 124). The apparatus can be a separate from the gas flare or can be incorporated into the construction of the gas flare.

1 Claim, 2 Drawing Sheets

METHOD AND APPARATUS FOR IGNITING A GAS FLARE AND A GAS FLARE

FIELD OF THE INVENTION

The present invention relates to a method and an apparatus for igniting a gas flare and a gas flare equipped with the apparatus.

BACKGROUND OF THE INVENTION

Gas flares are used to burn combustible waste gases. Every gas flare has a pilot light or some other form of igniter to ensure that the gas flare does not go out, resulting in the waste gases being vented directly into the atmosphere. This is particularly important with hydrogen sulfide gas which is potentially lethal to human and animal life in relatively low concentrations.

An increase in environmental awareness has lead to the monitoring of emissions from gas flares. It has been determined that if the waste gases are not burned at sufficiently high temperatures, noxious byproducts can be found in the emissions from the gas flares. The waste gas are, therefore, being burned at temperatures in a range of 2000 to 2800 degrees Fahrenheit, in order to obtain a "clean" burn.

A problem being encountered is that most forms of igniters have an unexceptably short life span when placed in an environment in the temperature range of 2000 to 2800 degrees Fahrenheit.

SUMMARY OF THE INVENTION

What is required is a more robust form of igniter which can function for relatively long time periods in an environment of extreme heat.

According to one aspect of the present invention there is provided a method of igniting a gas flare. The method includes the step of passing a combustible mixture of combustion air and combustible gases by a body of heat conducting material maintained at a temperature above an ignition temperature of the combustible gases, such that the combustible mixture is ignited immediately upon coming in contact with the body.

According to another aspect of the present invention there is provided an apparatus for igniting a gas flare which includes a housing and at least one flow passage extending through the housing. A body made from a heat conducting material in communication with the at least one flow passage. Means is provided for maintaining the body at a temperature above an ignition temperature of a combustible mixture of combustion air and combustible gases. The combustible mixture passing along the at least one flow passage is ignited immediately upon coming in contact with the body.

According to a final aspect of the present invention there is provided a gas flare which includes a housing and at least one flow passage extending through the housing. At least one body made from a heat conducting material extends through the housing into the at least one flow passage. Means is provided for maintaining the body at a temperature above an ignition temperature of a combustible mixture of combustion air and combustible gases, such that the combustible mixture passing along the at least one flow passage is ignited immediately upon coming in contact with the body.

In accordance with the teachings of the present invention the body glows red hot and serves as an igniter. There are various types of materials that are suitable when constructing the body; beneficial results have been obtained through the use of ceramic material. A heating element embedded in the ceramic body has proven to be a suitable means for maintaining the body at a temperature above the ignition temperature of the combustible mixture.

In the preferred embodiment of gas flare, which will hereinafter be described, the housing has an inlet and an outlet. One or more baffles are positioned within the housing to form interconnected parallel flow passages which collectively define a flow path extending from the inlet to the outlet. With this construction the ceramic igniter body extends through the housing across the flow passages and a combustible mixture passing along any of the flow passages is ignited immediately upon coming in contact with the body.

In the preferred embodiment of gas flare, which will hereinafter be described, one or more fans are provided to direct the combustible mixture along the flow path from the inlet toward the outlet and contribute combustion air.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
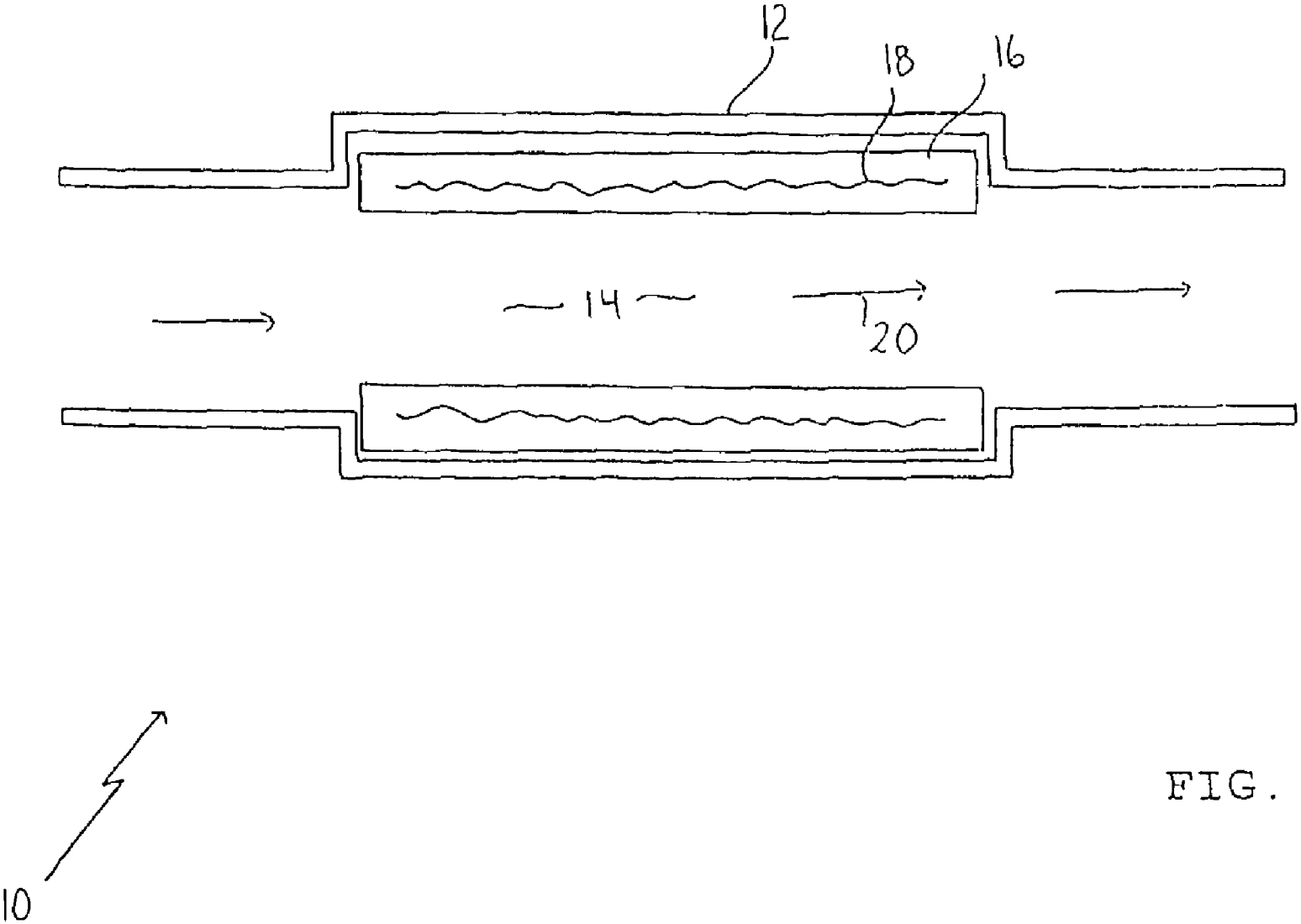
FIG. 1 is a side elevation view, in section, of an apparatus for igniting a gas flare constructed in accordance with the teachings of the present invention.

The preferred method will now be described with reference to an apparatus for igniting a gas flare, generally identified by reference numeral 10 and illustrated in FIG. 1 and a gas flare generally identified by reference numeral 100 and illustrated in FIG. 2.

Structure and Relationship of Parts for Apparatus 10:

Referring to FIG. 1, igniter apparatus 10 includes a cylindrical housing 12. A flow passage 14 extends through housing 12. An annular ceramic body 16 lines flow passage 14. A heating element 18 imbedded in ceramic body 16 serves to maintain ceramic body 16 at a temperature above an ignition temperature of a combustible mixture of combustion air and combustible gases.

Operation:

The use and operation of igniter apparatus 10 will now be described with reference to FIG. 1. Igniter apparatus 10 is suitable for use where it is necessary to have a form of igniter which can function for relatively long time periods in an environment of extreme heat. To make use of apparatus 10, a combustible mixture of combustion air and combustible gases is passed along flow path 14 within housing 12 and by ceramic body 16, as described above. Arrows 20 indicate the direction of the flow of the combustible mixture. Ceramic body 16 glows red hot and serves as an igniter. As ceramic body 16 is of a heat conducting material, ceramic body 16 can be maintained at a temperature above an ignition temperature of the combustible gases so that combustible mixture is ignited immediately upon coming in contact with ceramic body 16. Heating element 18 serves to maintain ceramic body 16 at the desired temperature above the ignition temperature of the combustible gases.

Igniter apparatus 10 can be used with various makes and models of gas flare in place of more conventional igniters. However, these same principles can be used in construction of a gas flare as will hereafter be described.

Structure and Relationship of Parts for Gas Flare 100

Figure 2:
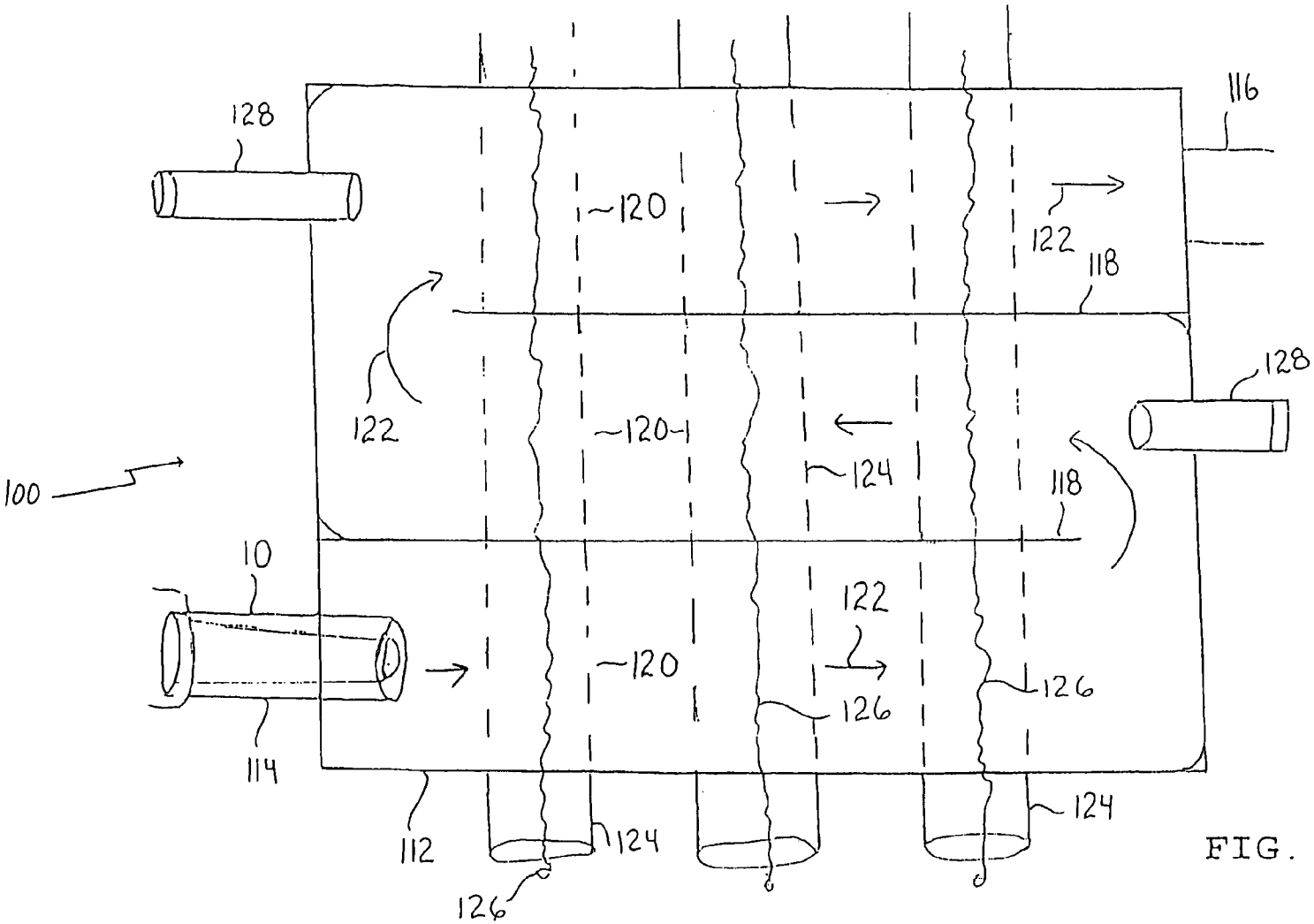
FIG. 2 is a side elevation view, in section, of a gas flare constructed in accordance with the teachings of the present invention.

Referring to FIG. 2, gas flare 100 includes a ceramic housing 112 which has an inlet 114, an outlet 116, and two baffles 118. Baffles 118 are positioned within housing 112 to form three interconnected parallel flow passages 120 which collectively define a flow path, as indicated by arrows 122, that extends from inlet 114 to outlet 116. While the illustrated embodiment shows two baffles 118, it will be appreciated that as few as one or more than two baffles could also be used so long as baffles 118 define flow path 122 that extends from inlet 114 to outlet 116.

Several bodies 124 made from a heat conducting material extend through housing 112 across flow passages 120. Preferably the bodies are ceramic. Bodies 124 glow red hot and serve as igniters. A heating element 126 is embedded in each of ceramic bodies 124 to maintain ceramic bodies 124 at a temperature above an ignition temperature of a combustible mixture of combustion air and combustible gases, such that as combustible mixture is passing along any of flow passages 120, combustible mixture is ignited immediately upon coming in contact with any of ceramic bodies 124. Fans 128 are placed in each of flow passages 120 to direct the flow of combustible mixture along flow path 122 from inlet 114 toward outlet 116 and to provide combustion air.

Operation:

The use and operation of gas flare generally identified by reference numeral 100 will now be described with reference to FIG. 2. Gas flare 100 is used where it is necessary to burn a combustible mixture of combustion air and combustible gases at temperatures in a range of 2000 to 2800 degrees Fahrenheit in order to eliminate noxious byproducts which can otherwise be found in the emissions from gas flares 100. The combustible mixture of combustion air and combustible gases enters housing 112 though inlet 114 and passes along interconnected parallel flow passages 120 which collectively define flow path as indicated by arrows 122 which extends from inlet 114 to outlet 116. Combustible mixture is directed along flow passages 120 by fans 128 which also provide combustible air. Combustible mixture passing along any of flow passages 120 is ignited immediately upon coming in contact with bodies 124 which are maintained by heating element 126 at a temperature above an ignition temperature of a combustible mixture of combustion air and combustible gases.

Variations:

Referring to FIG. 1, apparatus 10, as described above, can be used separately from gas flare 100 illustrated in FIG. 2, or it can be incorporated into the construction of gas flare 100 to serves as an igniter for gas flare 100. Referring to FIG. 2, to incorporate apparatus 10 into the construction of gas flare 100, apparatus 10 is secured to inlet 114 of gas flare 100. When secured to gas flare 100, apparatus 10 operates in the manner described above.

The embodiments of the invention in which an exclusive property or privilege is claimed are defined as follows:

1. A gas flare, comprising:

a housing;

at least one combustible gas flow passage extending through the housing;

an annular ceramic igniter body disposed in the housing and lining the at least one combustible gas flow passage such that combustible gas flowing through the gas flow passage is surrounded by the annular ceramic igniter body and flows through the annular ceramic igniter body; and a heating element embedded in the annular ceramic igniter body, the heating element extending longitudinally through the annular ceramic igniter body in the direction of the flow of gas through the gas flow passage and maintaining the body at a temperature above an ignition temperature of a combustible mixture of combustion air and combustible gases, such that the combustible mixture passing along the at least one combustible gas flow passage is ignited immediately upon coming in contact with the annular ceramic igniter body lining the at least one combustible gas flow passage.

* * * * *